US006171069B1

(12) United States Patent
Levitin et al.

(10) Patent No.: US 6,171,069 B1
(45) Date of Patent: Jan. 9, 2001

(54) JET PUMP HAVING A MOVABLE PISTON

(75) Inventors: Mikhail Levitin; Boris Khaytin, both of P.O. Box 102, Reeders, PA (US) 18352

(73) Assignees: Mikhail Levitin; Boris Khaytin, both of Reeders, PA (US)

( * ) Notice: Under 35 U.S.C. 154(b), the term of this patent shall be extended for 0 days.

(21) Appl. No.: 09/357,110

(22) Filed: Jul. 19, 1999

(51) Int. Cl.[7] ..... F04F 5/48
(52) U.S. Cl. ..... 417/187; 417/182; 417/189
(58) Field of Search ..... 417/182, 187, 417/189, 151, 197, 198; 62/191, 116, 226

(56) References Cited

U.S. PATENT DOCUMENTS 607,849 * 7/1898 Hampson .
3,199,310 * 8/1965 Schlichtig ..... 62/500
3,277,660 * 10/1966 Kemper et al. ..... 62/116
3,680,327 * 8/1972 Stein ..... 62/226
4,342,200 * 8/1982 Lowi, Jr. ..... 62/191
5,454,696 * 10/1995 Wilkinson ..... 417/198
5,820,353 * 10/1998 Beylich et al. ..... 417/198
5,954,481 * 9/1999 Baier et al. ..... 417/182

* cited by examiner

*Primary Examiner*—Teresa Walberg
*Assistant Examiner*—Jeffrey Pwu

(57) ABSTRACT

A refrigeration unit having a jet pump with an automatically adjustable cross-section for the control of refrigerant flow that provides a more economical refrigeration process. The circulation of thermotransfering materials, such as a refrigerant, through the jet pump's evaporator facilitates a more efficient cooling effect.

3 Claims, 3 Drawing Sheets

JET PUMP HAVING A MOVABLE PISTON

The present invention relates to jet pumps and their application to cooling and heating systems for thermal control processes.

BACKGROUND OF THE INVENTION

Human productivity and quality of life has been substantially increased in recent years by the use of efficient climate control equipment, such as air conditioning. The growing demands for food preservation on the one hand and energy-saving requirements on the other hand could be satisfied only with effective and economical thermal control systems. There are existing refrigeration systems which consist of a refrigerant vapor compressor discharging into a condenser which liquefies the refrigerant while it emits heat to the surroundings. This is followed by partially vaporizing the liquid refrigerant and lowering its temperature by means of absorbing its latent heat of vaporization. The refrigerant then passes through the evaporator which vaporizes the remaining liquid and absorbs the heat from the cooling object. The produced vapor then returns to the compressor to repeat the cycle again. The circulation of the thermotransfering materials such as a refrigerant through the evaporator makes the process of absorbing heat from the cooling object more efficient.

Suitable forms of jet pumps for the circulating refrigerant are comprised of a suction inlet for entering liquid which is then lifted by the pump into the mixing chamber, a jet with an inlet for the introduction of high-pressure liquid. The high-pressure liquid, called working liquid, flows into the mixing chamber and creates a suction effect at the suction inlet. The low-pressure liquid, called secondary liquid, is lifted by the pump and sucked into the mixing chamber.

An early example of a jet pump is disclosed in U.S. Pat. No. 607,849 by Hampson in 1898. Subsequently, multiple attempts to increase efficiency of conventional jet pumps for refrigerating systems were made. For example in the U.S. Pat. Nos. 3,199,310 by Schlichting, 2,301,839 by Work, and 3,277,660 by Kemper disclosed the idea of using different liquids as secondary and working liquids to increase the efficiency of the jet pump. In U.S. Pat. No. 3,680,327 by Stein disclosed a "compound ejector" for use in steam-jet refrigeration that introduces multiple primary jets through stationary nozzles in order to mix secondary and working liquids. In U.S. Pat. No. 4,378,681 by Modisette, U.S. Pat. No. 4,748,826 by Lauman, and U.S. Pat. No. 5,647,221 by Garris, Jr. are disclosed the idea of using virtual flow for increasing the efficiency of a jet pump or an ejector.

It is known that heat loading on the cooling system during the refrigeration or freezing process is variable and the quantity of the refrigerant circulating through a freezer or a refrigerator changes to large extent throughout the process. The greatest quantity of the refrigerant circulates at the beginning of the process. Some time later, the quantity of the refrigerant must be reduced due to the decreasing amount of heat transferring from cooled object and refrigerant. The final step of the process requires further reduction of the feeding refrigerant. Obviously, the optimum process should allow adjusting the quantity of the feeding refrigerant according to the amount of heat exchanged.

All of described types of the jet pumps have a constant cross section of the nozzles. Therefore they can not change the quantity of a refrigerant introduced into an evaporator and thus cannot reduce the time of the refrigeration process. Accordingly, a need exists for improving the jet pump for circulating refrigerant in order to increase the effectiveness of the refrigeration process.

SUMMARY OF THE INVENTION

The present invention provides improvement of the construction of jet pumps. The cross section of the nozzle of the jet pump varies during the refrigeration process depending upon the pressure inside an evaporator. This effect is achieved by placing a movable piston into a narrowing of the output channel of the pump. The movable piston changes the cross-section of the jet pump through which the high pressure refrigerant (working liquid) passes through to the mixing chamber of the jet pump. That piston is in dynamic equilibrium by means of its weight and the difference in pressure of the refrigerant before and after flowing around the piston. Therefore the variation in the diameter of the ring-shaped nozzle is the result of the change in the distance between the margin of the upper part of the piston and the wall of the narrowing channel through which high-pressure refrigerant is introduced.

According to the second embodiment of the present invention the piston is in dynamic equilibrium by means of its weight, resistance of a buffer placed between the stopper and the screen, and the difference in pressure of the refrigerant before and after the piston. Therefore the variation in the diameter of the ring-shaped nozzle is the result of the change in the distance between the margin of the upper part of the piston and the wall of the narrowing channel through which high-pressure refrigerant is introduced.

According to the third embodiment of the present invention the piston is placed on the pipe which introduces the low-pressure refrigerant to the mixing chamber. The pipe is positioned within the body of the jet pump so that the output channel is at the narrowing portion of the body of the jet pump. At the output channel high-pressure refrigerant is introduced into the mixing chamber.

The above described and many other features and attendant advantages of the present invention will become apparent as the invention becomes better understood by reference to the following detailed description when considered in conjunction with the accompanying drawings.

DESCRIPTION OF THE DRAWINGS

Detailed descriptions of the preferred embodiments of the present invention will be made preference to the accompanying drawings.

The above described and many other features and attendant advantages of the present invention will become apparent as the invention becomes better understood by reference to the following detailed description when considered in conjunction with the accompanying drawings.

DETAILED DESCRIPTION OF THE EMBODIMENTS

The following is a detailed description of the best presently known mode of carrying out the invention. This description is not to be taken in a limiting sense, but is made merely for the purpose of illustrating the general principles of the invention. The scope of the invention is defined by the appended claims.

Figure 1:
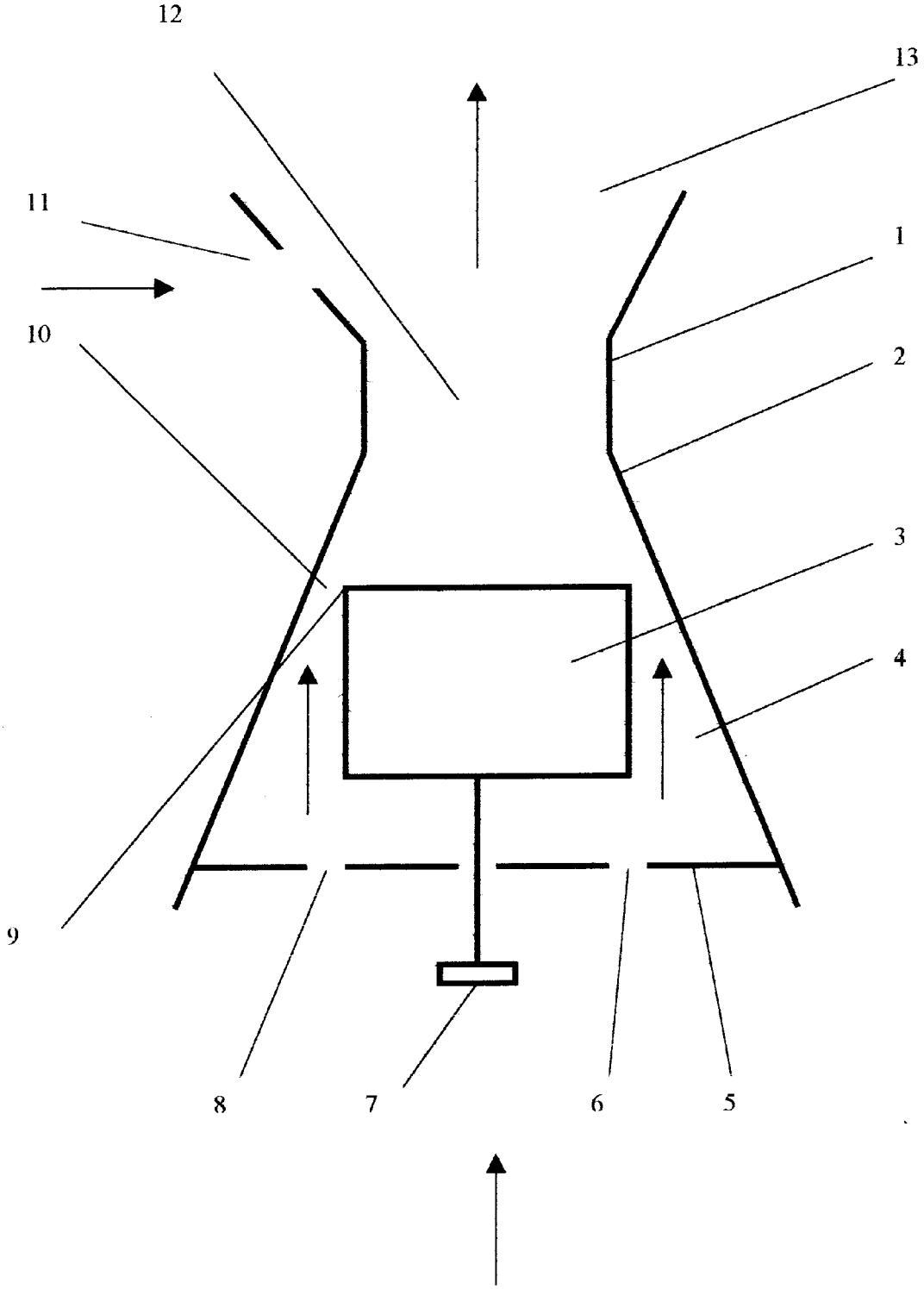
FIG. 1 shows the cross-section view of the jet pump in accordance with the first embodiment of the present invention.

Jet pump 1 (see FIG. 1) consists of an evaporator body 2, a narrowing channel 4 with an inlet 8 and an outlet 12, a mixing chamber 13 and inlet 11 for the entrance of low-pressure refrigerant, a screen 5 with holes 6, and a movable piston 3 with a stopper 7 and upper part 9, a ring-shaped nozzle 10 formed between the margin of the upper part 9 of the movable piston 3 and inside surface of the narrowing channel 4.

High pressure refrigerant enters the jet pump through the inlet 8, holes 6, flows around the movable piston 3 and through the ring-shaped nozzle 10 between the inside surface of narrowing channel 4 and the margin of upper part 9 of the piston 3, into outlet 12 to the mixing chamber 13. The low-pressure refrigerant is introduced into the mixing chamber 13 through the inlet 11 due to the reducing pressure of high-pressure refrigerant within the outlet 12 and mixes with high-pressure refrigerant. At the beginning of refrigeration the pressure above the piston 3 is higher than below it and causes the piston to move down thereby expanding the cross-section area of the ring-shape nozzle 10. As refrigeration proceeds the pressure under the piston 3 increases causing the piston to move up thereby reducing the cross-section area of the ring-shape nozzle 10. The vertical motion of the piston 3 automatically changes the quantity of refrigerant introduced into the evaporator. If the pressure of working liquid (high-pressure refrigerant) rises too rapidly, the stopper 7 prevents the plugging of the outlet 12.

Figure 2:
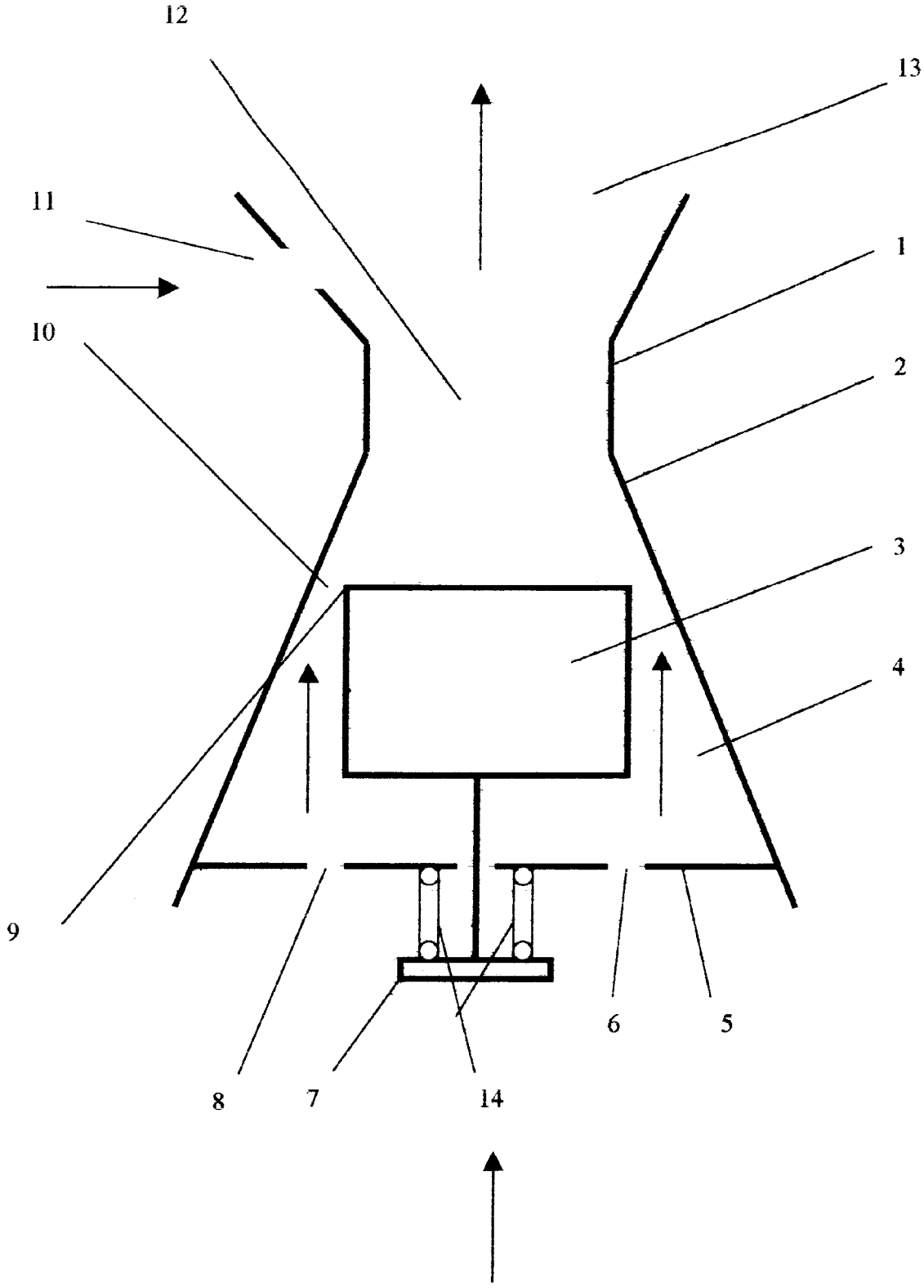
FIG. 2 shows the cross-section view of the jet pump in accordance with FIG. 1, further comprised of a buffer.

According to the second embodiment of the present invention jet pump 1 (see FIG. 2) consists of a body 2, a narrowing channel 4 with an inlet 8 and an outlet 12, a mixing chamber 13 and inlet 11 for the entrance of low-pressure refrigerant, a screen 5 with holes 6, and a movable piston 3 with a stopper 7 and upper part 9, a ring-shaped nozzle 10 formed between margin of the upper part 9 of the movable piston 3 and inside surface of the narrowing channel 4, a buffer 14.

High pressure refrigerant enters the jet pump through the inlet 8, holes 6, flows around the movable piston 3 and through the ring-shaped nozzle 10 between the inside surface of narrowing channel 4 and the margin of upper part 9 of the piston 3 into outlet 12 to the mixing chamber 13. The low-pressure refrigerant is introduced to the mixing chamber 13 through the inlet 11 due to the reducing pressure of high-pressure refrigerant within the outlet 12 and mixes with high-pressure refrigerant. At the beginning of refrigeration the pressure above the piston 3 is higher than below it and causes the piston to move down thereby expanding the cross-section area of the ring-shaped nozzle 10. As refrigeration proceeds the pressure under the piston 3 increases causing the piston to move up thereby reducing the cross-section area of the ring-shaped nozzle 10. The vertical motion of the piston 3 automatically changes the quantity of refrigerant introduced into the evaporator. If the pressure of working liquid (high-pressure refrigerant) rises too rapidly, the stopper 7 and the buffer 14 prevent the plugging of the outlet 12.

Figure 3:
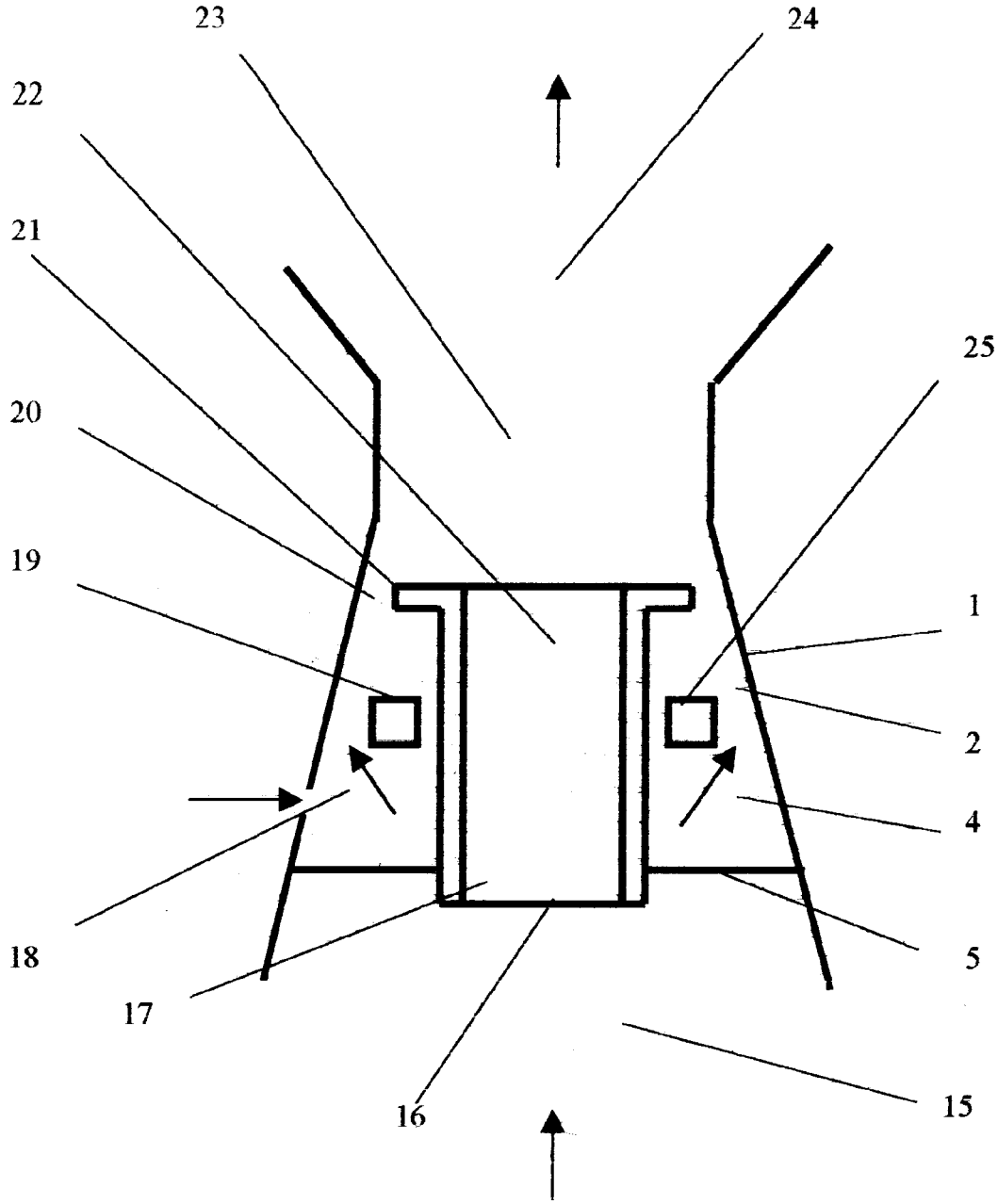
FIG. 3 shows the cross-section of the jet pump with the movable piston located on the pipe introducing the low-pressure refrigerant into the mixing chamber.

According to the third embodiment of the present invention jet pump 1 (see FIG. 3) consists of a body 2, a narrowing channel 4 with outlet 23, a mixing chamber 24, and an inlet 18 for the entrance of high-pressure refrigerant, a screen 5, a pipe 17 with inlet 16, outlet 22 and flange 21 placed into the channel 4, and movable piston 25 with upper part 19. Between the margin of the upper part 19 of the movable piston 25 and the inside surface of the narrowing channel 4 is formed a ring-shaped nozzle 20.

High-pressure refrigerant enters the jet pump through the inlet 18, flows around the movable piston 25 and through the ring-shaped nozzle 20 between the inside surface of the narrowing channel 4 and the margin of the upper part 19 of the piston 25 into outlet 23 to the mixing chamber 24. The low-pressure refrigerant is introduced into the mixing chamber 24 through the outlet 22 of the pipe 17 due to the reducing pressure of high-pressure refrigerant and mixes with high-pressure refrigerant.

At the beginning of refrigeration the pressure above the piston 25 is higher than below it and causes the piston to move down thereby expanding the cross-section area of the ring-shaped nozzle 20. As refrigeration proceeds the pressure under the piston 25 increases causing the piston to move up thereby reducing the cross-section area of the ring-shaped nozzle 20. The vertical motion of the piston automatically changes the quantity of refrigerant introduced into the evaporator. If the pressure of working liquid (high-pressure refrigerant) rises too rapidly, the flange 21 of the pipe 17 prevents the plugging of the ring-shaped nozzle 25.

This invention has been described in its presently contemplated best modes, and it is clear that it is susceptible to numerous modifications, modes and embodiments within the ability of those skilled in the art without the exercise of the inventive faculty. Accordingly, the scope of this invention is defined by the scope of the following claims.

We claim:

1. A jet pump comprising a body, a narrowing channel with a inlet and an outlet, a mixing chamber, an inlet for the entrance of a low-pressure refrigerant, a screen with holes, and a movable piston with a stopper and a upper part where said ring-shaped nozzle is formed between the margin of said upper part of said movable piston and the inside surface of said narrowing channel.

2. A jet pump comprising a body, a narrowing channel with an inlet and an outlet, a mixing chamber, an inlet for the entrance of a low-pressure refrigerant, a screen with holes, and a movable piston with a stopper and an upper part where a ring-shaped nozzle is formed between the margin of said upper part of a movable piston and the inside surface of a narrowing channel, and a buffer placed between said stopper and said screen.

3. A jet pump comprising consists of a body, a narrowing channel with an inlet and an outlet, a mixing chamber, an inlet for the entrance of a high-pressure refrigerant, a screen, a pipe placed into a channel and having of an inlet and an outlet, a movable piston with an upper part where a ring-shaped nozzle is formed between the margin of said upper part of said movable piston and inside surface of said narrowing channel.

* * * * *